US008485001B2

(12) United States Patent
Mette et al.

(10) Patent No.: US 8,485,001 B2
(45) Date of Patent: Jul. 16, 2013

(54) HOUSEHOLD APPLIANCE HAVING A TUB WITH A FLUID GUIDE

(75) Inventors: Uwe Mette, New Bern, NC (US); Jonathan Murrell, Cookeville, TN (US); Ramon Rodriguez, New Bern, NC (US); Rolf Schuck, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 173 days.

(21) Appl. No.: 13/025,452

(22) Filed: Feb. 11, 2011

(65) Prior Publication Data

US 2011/0132041 A1 Jun. 9, 2011

Related U.S. Application Data

(63) Continuation-in-part of application No. 12/533,040, filed on Jul. 31, 2009.

(51) Int. Cl.
*D06F 21/00* (2006.01)

(52) U.S. Cl.
USPC ..... 68/139; 68/17 R; 68/140; 68/3 R

(58) Field of Classification Search
USPC ..... 68/139
See application file for complete search history.

(56) References Cited

U.S. PATENT DOCUMENTS

| | | | | |
|---|---|---|---|---|
| 4,423,607 | A | 1/1984 | Munini | |
| 7,454,927 | B2 * | 11/2008 | Luckman et al. | 68/13 R |
| 7,757,324 | B2 * | 7/2010 | Leidig et al. | 8/159 |
| 2008/0236205 | A1 | 10/2008 | Kim et al. | |
| 2009/0165504 | A1 | 7/2009 | Kim | |

FOREIGN PATENT DOCUMENTS

| | | | |
|---|---|---|---|
| EP | 1975298 | A1 * | 10/2008 |
| EP | 2100996 | A1 | 9/2009 |

OTHER PUBLICATIONS

International Search Report PCT/EP2010/060827.

* cited by examiner

*Primary Examiner* — Michael Barr
*Assistant Examiner* — Thomas Bucci
(74) *Attorney, Agent, or Firm* — James E. Howard; Andre Pallapies

(57) ABSTRACT

A household appliance includes a housing having a door formed in a front panel thereof for accessing an interior of the housing, a tub disposed inside the housing, and a rotatable drum within the tub and having an axis of rotation, the rotatable drum for receiving laundry through the door. The tub includes a tub body, a heater pocket integrally formed in a lower portion of the tub body, the heater pocket forming a cavity in fluid communication with the drum, the heater pocket for at least partially surrounding a heating element for heating a fluid in the tub, and a fluid guide on an interior surface of the tub, the fluid guide one of guiding the fluid from the tub body into the heater pocket and disrupting a fluid ring formed in the tub body during rotation of the rotatable drum.

31 Claims, 13 Drawing Sheets

HOUSEHOLD APPLIANCE HAVING A TUB WITH A FLUID GUIDE

CROSS-REFERENCE TO RELATED APPLICATION

The present application is a Continuation-In-Part Application of copending application Ser. No. 12/533,040, filed on Jul. 31, 2009, for which priority is claimed under 35 U.S.C. §120; the entire contents of the above identified patent application are hereby incorporated by reference.

FIELD OF THE INVENTION

The present invention is directed toward a household appliance, and more specifically, toward a household appliance having a tub including a fluid guide.

BACKGROUND OF THE INVENTION

FIGS. 1-4 illustrate a conventional household appliance 100, such as a front-loading clothes washer, having a housing 110 and a door 112 to provide access to the interior of the appliance housing 110. The housing 110 encloses a washing unit, which includes a tub 210 having a rotating washing drum 215 that rotates or oscillates about an axis to move the clothes or laundry in the tub 210. A drive system rotates or oscillates the rotating washing drum 215 within the tub 210 about the axis of the drum 215. The drive system can include, for example, a motor 214, a pulley 216, and a drive belt 218. The interior of the tub 210 is accessible through the opening 212, which corresponds to the door 112 of the housing 110, as illustrated in FIG. 1. In operation, clothes or laundry are inserted into the washer 100 through the door 110 and placed in the rotating washing drum 215 inside the tub 210. The household appliance 100 wets the laundry to be washed with a fluid, such as a washing liquid, rinsing liquid, water, or other fluid, and mechanically moves the laundry to release contaminants from the laundry.

As shown in FIGS. 2-4, the tub 210 can include a heater pocket 300 having a heating element 400 disposed therein. The washing unit also can include a drain assembly 220 coupled to or formed in the tub 210. The drain assembly 220 can be in fluid communication with the heater pocket 300. The drain assembly 220 can include, for example, a discharge pump (not shown) and corrugated tube for discharging the fluid from the tub 210.

With reference again to FIG. 4, an example of a conventional heater pocket 300 includes a first sidewall 302, a second sidewall 304, and a bottom wall 306. A plate 502 can be coupled to or integrally formed with the bottom wall 306 of the heater pocket 300. A heater coil retainer clip 402 can be coupled to the plate 502. During assembly of the household appliance, a heating element 400 having heater coils 404 and a fixation base 406 can be inserted into and sealingly engaged with an opening at the far end of the heater pocket 300, as viewed in FIG. 4. The heater coils 404 engage and are retained by the heating element retainer clip 402.

The interior surface of the bottom wall 306 can be sloped in a direction toward the drain assembly 220 to promote the flow of the fluid toward and into the drain assembly 220, as shown in FIG. 2. The drain assembly 220 (not shown in FIG. 4) is located at the near end of the heater pocket 300 as viewed in FIG. 4 (i.e., at an opposite end from the base 406 of the heating element 400). An opening into the drain assembly from the heater pocket can include a mesh screen, for example a metal screen, that prevents or reduces the flow of debris from the heater pocket 300 into the drain assembly.

FIG. 4 illustrates a cross-section of a conventional heater pocket taken in a direction substantially perpendicular to the axis of rotation of the drum 215. In the cross-section of the heater pocket 300, the first sidewall 302 and the second sidewall 304 of the heater pocket 300 are not perpendicular to the bottom wall 306. That is, the first sidewall 302 and the second sidewall 304 of the heater pocket 300 can be inclined at an angle other than 90° with respect to the bottom wall 306. For example, when viewed in cross-section, the first sidewall 302 can be inclined by a first angle and the second sidewall 304 can be inclined at a second angle with respect to the bottom wall 306. Other conventional heater pockets may include sidewalls that are perpendicular to the bottom wall 306.

FIGS. 5 and 6 schematically illustrate a conventional arrangement of a tub 210 and heater pocket 300 having a heating element 400 including a heater coil 404 and fixation base 406. The heater coil 404 is secured in the heater pocket 300 by the heating element retainer clip 402. The radii of the heater pocket 300 are indicated by dashed lines 301.

During operation, the rotation of the drum 215 induces flow F of the fluid into the heater pocket 300 in a first direction. The drum 215 can include paddle-shaped elements thereon for lifting or pushing the fluid as the drum 215 rotates, thereby inducing flow F of the fluid into the heater pocket in a first direction and then out of the other side of the heater pocket. During a heating cycle, the fluid flows from the drum 215 into the heater pocket 300, wherein the heater coils transfer heat to the fluid. The heated fluid then flows out of the heater pocket 300 and back into the drum 215. Similarly, during a rinsing cycle, the fluid flows from the drum 215 into the heater pocket 300 and then out of the heater pocket 300 and back into the drum 215. During the heating and/or rinsing cycles, the drum 215 may rotate in a first direction (e.g., a clockwise direction shown by flow F) for a period of time, and then rotate in a second direction (e.g., a counter-clockwise direction) for a period of time.

During a draining cycle of the washer, for example a spinning cycle, the drain is opened and the fluid is intended to flow from the drum 215 into the heater pocket 300 (flow F), and then is permitted to flow into, or be drawn into, the corrugated tubing of the drain assembly 220. As explained above, a discharge pump can be provided for drawing the fluid from the heater pocket 300 and the tub 210 into the drain assembly 220. During the draining cycle, the drum 215 may rotate in a single direction such that the fluid flows into the heater pocket 300 in a single direction, for example, a clockwise direction in FIGS. 1-4 (flow F).

The heating element 400 having heater coils 404 and a base 406, as well as the heating element retainer clip 402, commonly include features, such as sharp corners, edges, etc., that may be prone to collecting or accumulating debris, such as fluffs (e.g., lint or paper particles) and deposits or formation of lime.

SUMMARY OF THE INVENTION

The present invention recognizes that the deposition and accumulation of debris below, on, or around the heater coils can affect the heat distribution from the heater coils to the fluid, thereby reducing the efficiency of the washer. The deposition and accumulation of debris below, on, or around the heater coils also can result in early failure of the heating element, thereby affecting the durability and reliability of the washer.

For example, with reference to FIG. 4, such debris can collect or accumulate under, on, or around the heater coils 404, and eventually, can turn into a paste-like material or coating on the heater coils 404 that may function like a layer of insulation on the heater coils 404. This debris also can collect or accumulate on the heater coil retainer clip. In this manner, some of the most affected areas of the heater coils 404 may eventually lose some or all of their ability to transfer heat to the fluid. As a result, the time to heat the fluid in the tub can be increased. As more and more debris accumulates on the heater coils 404, the time to heat the fluid can become longer. Moreover, the insulating effect of the accumulated debris may cause overheating of the heating element, thereby resulting in early failure of the heating element and reducing the reliability of the washer.

The present invention also recognizes that, during operation, the dynamics of the drum motion (e.g., rotation of the drum during a spinning cycle) may cause the fluid (e.g., washing liquid, rinsing liquid, water, or other liquid) to form a fluid ring (i.e., water ring) spinning around the interior of the rotating drum or the interior of the tub such that at least a portion of the fluid skips over the heater pocket and fails to enter the heater pocket for draining, thereby reducing or limiting the drainage efficiency to the discharge pump. This also may lead to a reduction of the quantity and/or flow velocity of the fluid entering the heater pocket, which may result in low flow areas and/or stagnant areas (i.e., areas of minimal or no flow) below or around the heater coils 404, the base 406, and the heating element retainer clip 402. As a result, a large (or larger) amount of debris, such as fluffs (e.g., lint or paper particles) and lime, may collect and accumulate under, on, or around the heater coils 404, the base 406, and the heating element retainer clip 402, since the flow of fluid in the heater pocket may not be sufficient to sweep or clean this debris off of, or out from under, these parts.

These problems and others are addressed by the present invention, a first exemplary embodiment of which comprises a household appliance including a housing having a door formed in a front panel thereof for accessing an interior of the housing, a tub disposed inside the housing, and a rotatable drum within the tub and having an axis of rotation, the rotatable drum for receiving laundry through the door. The tub includes a tub body, a heater pocket integrally formed in a lower portion of the tub body, the heater pocket forming a cavity in fluid communication with the drum, the heater pocket for at least partially surrounding a heating element for heating a fluid in the tub, and a fluid guide on an interior surface of the tub, the fluid guide one of guiding the fluid from the tub body into the heater pocket and disrupting a fluid ring formed in the tub body during rotation of the rotatable drum.

Another exemplary embodiment of the invention comprises a household appliance including a housing having a door formed in a front panel thereof for accessing an interior of the housing, a tub disposed inside the housing, and a rotatable drum within the tub and having an axis of rotation, the rotatable drum for receiving laundry through the door. The tub includes a tub body, a heater pocket integrally formed in a lower portion of the tub body, the heater pocket forming a cavity in fluid communication with the drum, the heater pocket for at least partially surrounding a heating element for heating a fluid in the tub, and guide means for one of guiding the fluid from the tub body into the heater pocket and disrupting a fluid ring formed in the tub body during rotation of the rotatable drum.

Yet another exemplary embodiment of the invention comprises a tub for a household appliance having a housing with a door formed in a front panel thereof for accessing an interior of the housing, the tub for receiving a rotating drum having an axis of rotation, and the drum for receiving laundry through the door. The tub includes a tub body, a heater pocket integrally formed in a lower portion of the tub body, the heater pocket for at least partially surrounding a heating element for heating a fluid in the tub, and a fluid guide on an interior surface of the tub, the fluid guide one of guiding the fluid from the tub body into the heater pocket and disrupting a fluid ring formed in the tub body during rotation of the rotatable drum.

In this manner, the exemplary embodiments can provide a tub having a fluid guide that can guide (e.g., direct, divert, etc.) a fluid (e.g., a washing liquid, a rinsing liquid, water, or another liquid) toward or directly onto areas of the heater pocket that are prone to the accumulation of debris, such as fluffs (e.g., lint or paper particles) and deposits or formation of lime. For example, one or more guides can guide (e.g., direct, divert, etc.) the fluid directly onto the heater coils, the base, and/or the heating element retainer clip to flush or clean a portion or all of the debris from these areas. As a result, the exemplary embodiments can reduce or eliminate the deposition and accumulation of debris below, on, or around the heater coils, the base, and/or the heating element retainer clip, as well as other areas, thereby minimizing or eliminating a loss of efficiency of the heating element from deposition and accumulation of debris, and increasing a durability and reliability of the heating element.

The exemplary embodiments also can provide a tub having a fluid guide that breaks or disrupts the water ring that may be formed during a spinning cycle and guides (e.g., directs, diverts, etc.) the fluid into the heater pocket such that the fluid can be efficiently pumped or drained from the tub, thereby increasing the drainage efficiency of the household appliance, and improving the washing and cleaning affect of the fluid on areas that are prone to deposition and accumulation of debris. The exemplary embodiments can promote uniform flow of the fluid into the drain assembly during draining of the fluid, for example, during a spinning cycle. In this manner, the disclosed exemplary embodiments can reduce or eliminate stagnant areas, low flow areas, or irregular flow areas that may result in large amounts of debris collecting under, on, or around the heater coils. The exemplary embodiments can prevent or reduce the collection or accumulation of debris, such as fluffs (e.g., lint or paper particles) and lime deposits or formations under, on, or around the heater coils. In this manner, the exemplary embodiments may extend the operating life of the heater coils and increase the heat distribution from the heater coils to the fluid, thereby increasing the efficiency of the washer.

For purposes of this disclosure, a fluid guide is defined as an integral or discrete element that guides (e.g., directs, diverts, etc.) a fluid from the tub into the heater pocket and/or breaks the fluid ring (i.e., disrupts circular flow of fluid in the tub, or 'water ring') during rotation of the rotatable drum, such as during a spinning cycle. The fluid guide can include, for example, a rib, blade, diverter, protrusion, recess, channel, groove, trough, emboss, or similar element, or a combination thereof, that guides (e.g., directs, diverts, etc.) the fluid from the tub into the heater pocket and/or breaks the fluid ring, for example, during a spinning cycle.

An exemplary embodiment can include one or more fluid guides formed on an interior surface of the tub outside of (or adjacent to) to the heater pocket and on an upstream side of the heater pocket with respect to the direction of flow of the fluid during the spinning cycle. In another embodiment, one or more fluid guides can be formed, for example, on the sidewall of the heater pocket. In another embodiment, one or more fluid guides can be formed, for example, on the floor of the heater pocket.

One of ordinary skill in the art will recognize that one or more fluid guides can be formed only on one of the interior surface of the tub outside of (or adjacent to) to the heater pocket, the sidewall of the heater pocket, or the floor of the heater pocket. In an alternative embodiment, one or more fluid guides can be formed on two or more of the interior surface of the tub outside of (or adjacent to) to the heater pocket, the sidewall of the heater pocket, or the floor of the heater pocket.

For example, in other embodiments, one or more of the fluid guides can be formed on an interior surface of the tub beginning outside of (or adjacent to) the heater pocket and can continue onto the sidewall of the heater pocket. One or more of the fluid guides also can be formed on an interior surface of the tub beginning outside of (or adjacent to) the heater pocket and continue onto the sidewall of the heater pocket, and then onto the floor of the heater pocket, thereby directing, guiding, or diverting the fluid from the tub to predetermined areas, for example, of the heater element, heater retainer, or heater fixation base, etc. In another embodiment, one or more of the fluid guides can be formed on the sidewall of the heater pocket, and continue onto the floor of the heater pocket.

The fluid guide can be angled or curved (radii) with respect to the flow path of the fluid in the tub during, for example, the spinning cycle. The fluid guide can be a continuous element, or formed from a plurality of individual elements that operate in concert to guide (e.g., direct, divert, etc.) the fluid from the tub into the heater pocket.

Each of the fluid guides can have a uniform cross-sectional shape or a varying cross-sectional shape. For example, the fluid guide can have a square shape, curved shape, triangular shape, or other shape, such as a random shape. The fluid guide can be a continuous shape (e.g., step, sinusoidal, etc.) or separated by portions of the interior surface of the tub, the sidewall of the heater pocket, and/or the floor of the heater pocket.

The fluid guide can have a uniform or varied shape or dimension along the length of the fluid guide. For example, the fluid guide may be wider or narrower along the length or at one end of the length of the fluid guide to change the speed or acceleration of the fluid flowing in or along the fluid guide.

A plurality of fluid guides can be provided having a uniform or varied pattern or spacing. A portion of the fluid guides can be grouped together to guide (e.g., direct, divert, etc.) the fluid to one or more predetermined locations in the heater pocket, for example, for washing or cleaning debris from the heater element or retainer clip. For example, in an exemplary embodiment, one third of the fluid guides may guide (e.g., direct, divert, etc.) fluid to the heater bracket or retainer clip, one third of the fluid guides may guide (e.g., direct, divert, etc.) fluid to the heater element connection or fixation base, and one third of the fluid guides may guide (e.g., direct, divert, etc.) fluid under the heater coils. The fluid guide can guide (e.g., direct, divert, etc.) the flowing fluid to high critical points (e.g., around the heater retainer) to flush, wash, or clean debris that has accumulated or been deposited in those areas. In an embodiment, the heater pocket can include at least two fluid guides that guide (e.g., direct, divert, etc.) fluid to predetermined flush points for debris removal within the heater pocket.

A height or depth of the fluid guides with respect to a main interior surface of the tub is sufficient to guide (e.g., direct, divert, etc.) at least a portion of the fluid that is rotating in the tub into the heater pocket and/or to break the fluid ring (i.e., disrupt circular flow of fluid in the tub, or 'water ring') during, for example, a spinning cycle of the household appliance.

For example, in an embodiment having a fluid guide formed on the sidewall of the heater pocket and/or the floor of the heater pocket, a height of the fluid guide can extend in a radial direction toward the axis of rotation of the drum such that a first radial distance from the axis of rotation to the fluid guide is less than a second radial distance from the axis of rotation to the interior wall of the tub. In this manner, the fluid guide can project into the space between the tub and the drum to guide (e.g., direct, divert, etc.) at least a portion of the fluid that is rotating in the tub into the heater pocket and/or to break the fluid ring (i.e., disrupt circular flow of fluid in the tub, or 'water ring') during, for example, a spinning cycle of the household appliance.

Another exemplary embodiment can include fluid guide means for directing, guiding, or diverting fluid from the tub into the heater pocket and/or for breaking the fluid ring (i.e., disrupting circular flow of fluid in the tub) during a spinning cycle. The fluid guide means may include, for example, one or more integral or discrete elements, such as a fluid guide, that guides (e.g., directs, diverts, etc.) the fluid from the tub into the heater pocket and/or breaks the fluid ring (i.e., disrupts circular flow of fluid in the tub) during, for example, a spinning cycle.

Other arrangements are possible within the spirit and scope of the invention and other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
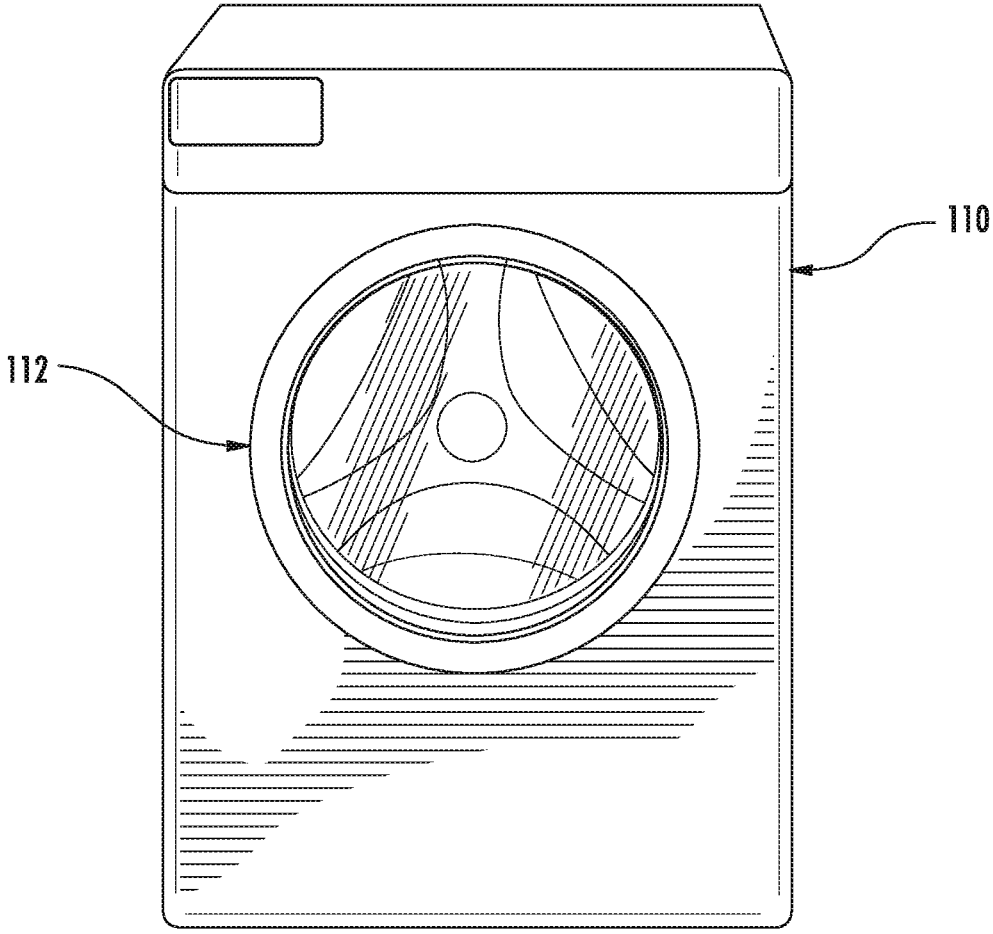
FIG. 1 is a front elevation view of a washer.
Figure 2:
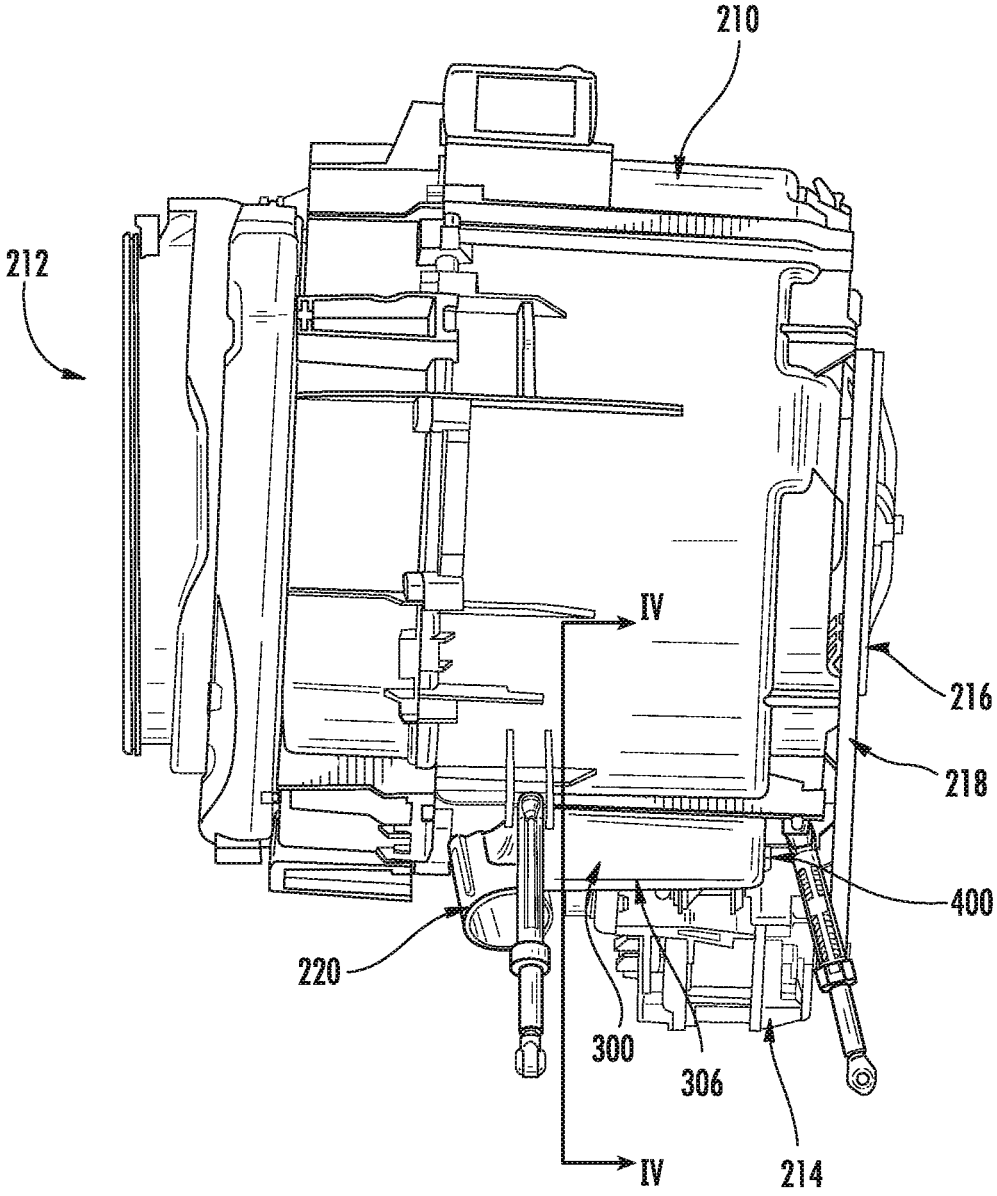
FIG. 2 CONVENTIONAL ART
FIG. 2 is a side elevation view of a conventional washing unit.
Figure 3:
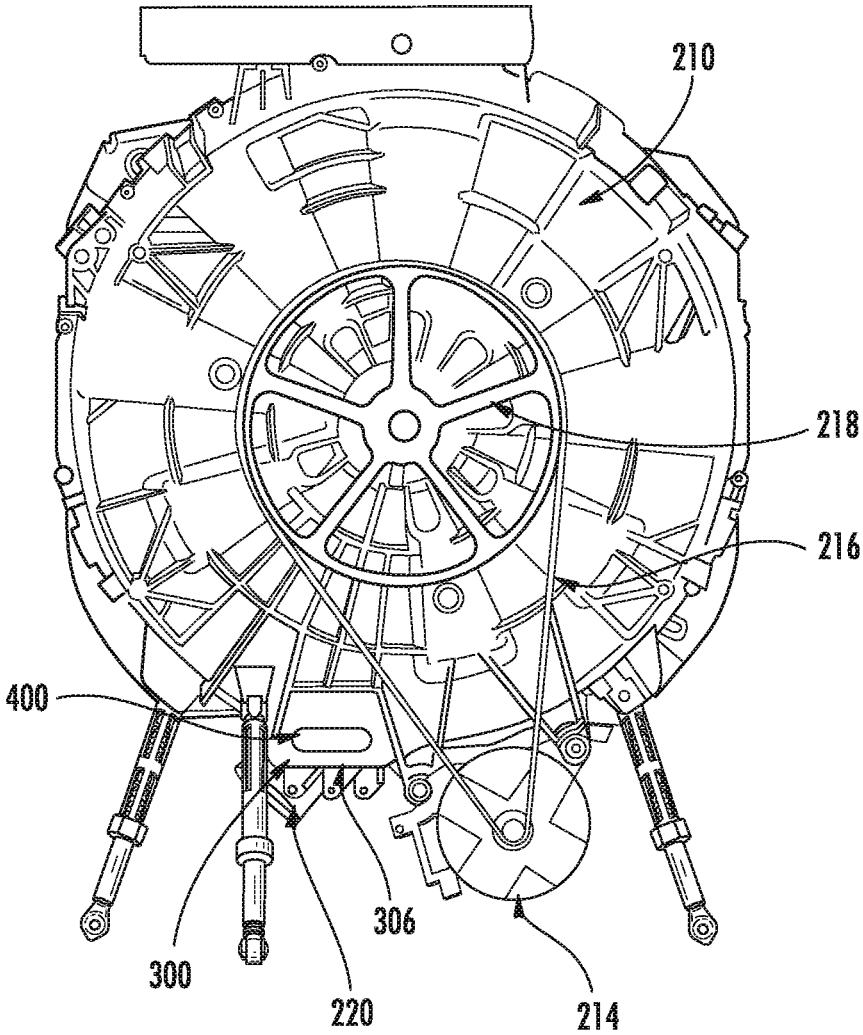
FIG. 3 CONVENTIONAL ART
FIG. 3 is a rear elevation view of the conventional washing unit of FIG. 2.

Referring now to the drawings, FIGS. 7-9K illustrate exemplary embodiments of a heater pocket having a fluid guide for a household appliance, such as a front-loading washer as shown in FIG. 1. The features illustrated in FIGS. 7-9K are for example purposes only and the embodiments are not limited, for example, to the disclosed exemplary configurations, arrangements, sizes, shapes, and/or appearances.

Figure 7:
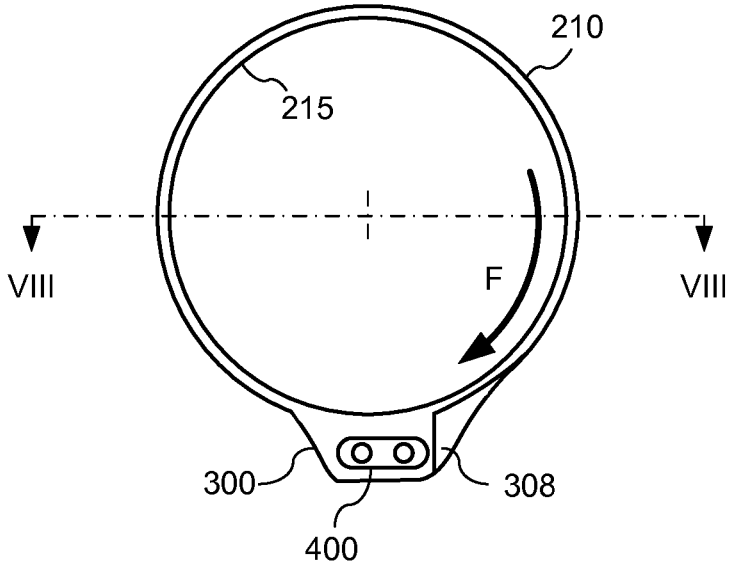
FIG. 7 is a schematic cross-sectional view of a washing drum and tub assembly having a heater pocket according to an exemplary embodiment.

FIG. 7 illustrates an assembly of a washing drum 215 and tub 210 of a household appliance according to an embodiment. The tub 210 includes a heater pocket 300 that is integrally formed in the bottom of the tub 210 for receiving a heating element 400. A fluid guide 308 is formed on an interior surface of the tub 210 (e.g., adjacent to the heater pocket and outside of the heater pocket 300, on a sidewall of the heater pocket 300, and/or on a floor of the heater pocket 300). The fluid guide 308 guides (e.g., directs, diverts, etc.) the fluid from the tub 210 into the heater pocket 300 along a new flow path F1.

Figure 4:
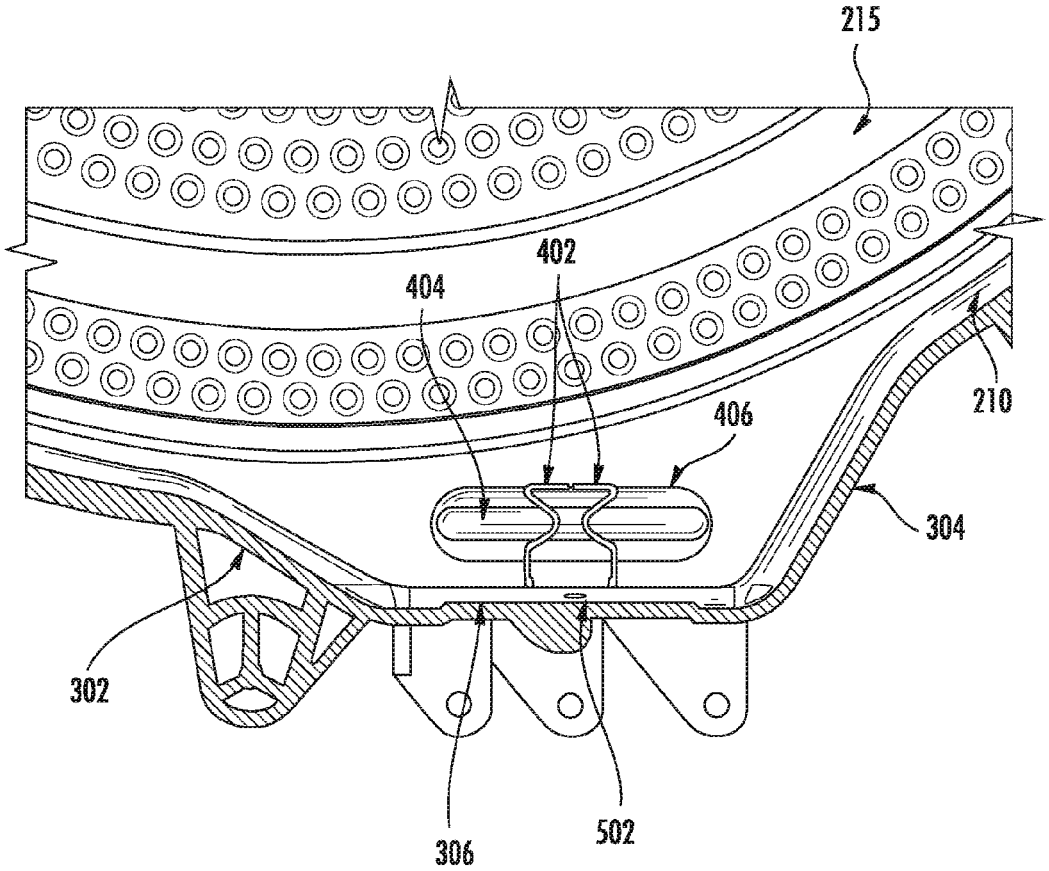
FIG. 4 CONVENTIONAL ART
FIG. 4 is a partial cross-sectional view of an exemplary conventional heater pocket according to FIG. 2 taken along the line IV-IV.
Figure 5:
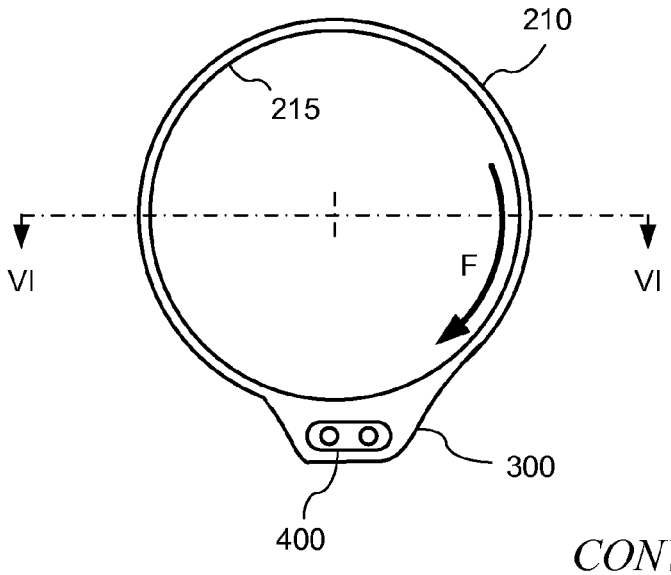
FIG. 5 CONVENTIONAL ART
FIG. 5 is a schematic cross-sectional view of a washing drum and tub assembly having a conventional heater pocket.
Figure 6:
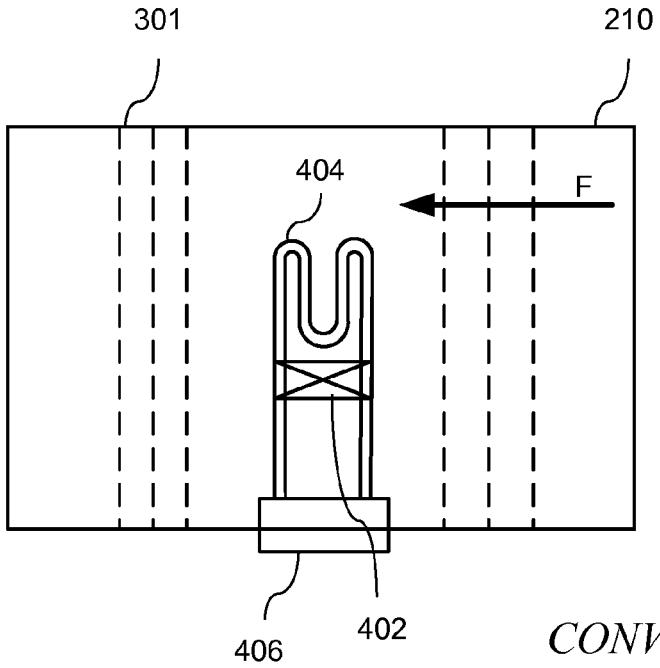
FIG. 6 CONVENTIONAL ART
FIG. 6 is a cross-sectional view of a tub of FIG. 5 taken along the line VI-VI.

With reference again to FIG. 7, a cross-section of the heater pocket 300, which is taken in a direction substantially perpendicular to the axis of rotation of the rotating drum 215, includes a first sidewall, a second sidewall opposed to the first sidewall, and a bottom wall connecting a lower side of the first sidewall to a lower side of the second sidewall, similar to the conventional heater pocket 300 shown in FIG. 4.

FIGS. 8A-8I illustrate exemplary embodiments of a heater pocket 300 having a fluid guide 308. Various arrangements of the fluid guide 308 can be provided for directing or guiding the fluid from the tub 210 into the heater pocket 300 and/or breaking or disrupting the fluid ring in the tub 210 during, for example, a spinning cycle. The arrangements illustrated in FIGS. 8A-8I are for example purposes only and the embodiments are not limited to these disclosed exemplary embodiments.

With reference to FIGS. 8A-8I, one or more fluid guides 308 can be formed (e.g., integrally formed) on an interior surface of the tub 210 outside of (or adjacent to) to the heater pocket 300 and on an upstream side of the heater pocket 300 with respect to the direction of flow F of the fluid during, for example, the spinning cycle. In another embodiment, one or more fluid guides 308 can be formed (e.g., integrally formed) on one of the first sidewall and the second sidewall of the heater pocket 300. In yet another embodiment, one or more fluid guides 308 can be formed, for example, on the floor of the heater pocket 300.

Figure 8A:
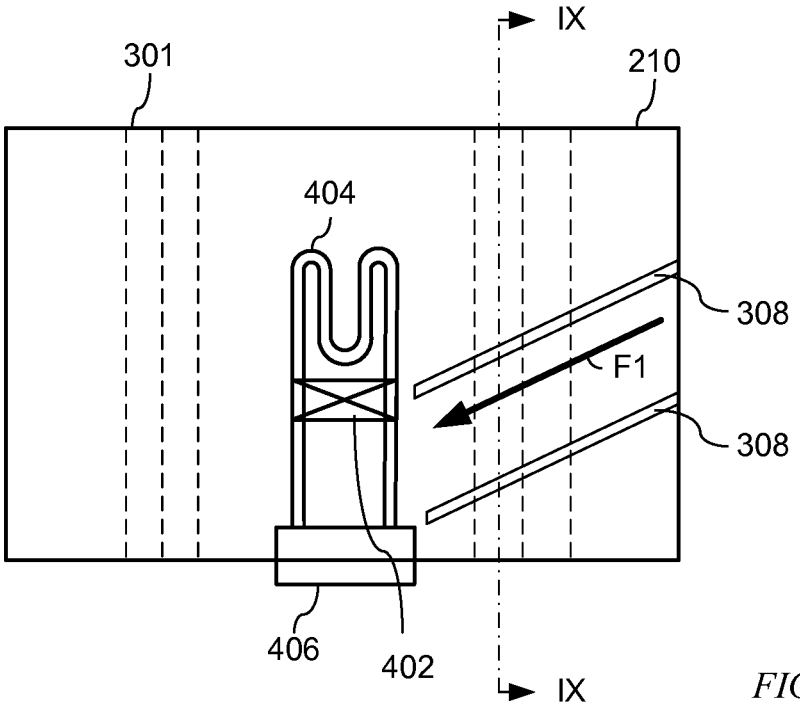
FIGS. 8A-8I are partial cross-sectional views of exemplary embodiments of the tub of FIG. 7 taken along the line VIII-VIII.
Figure 8B:
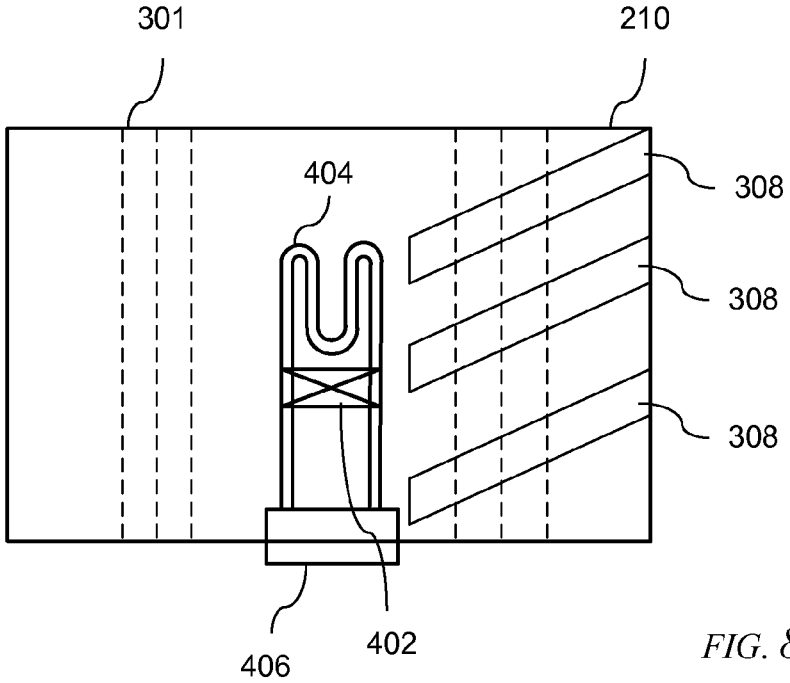
Figure 8C:
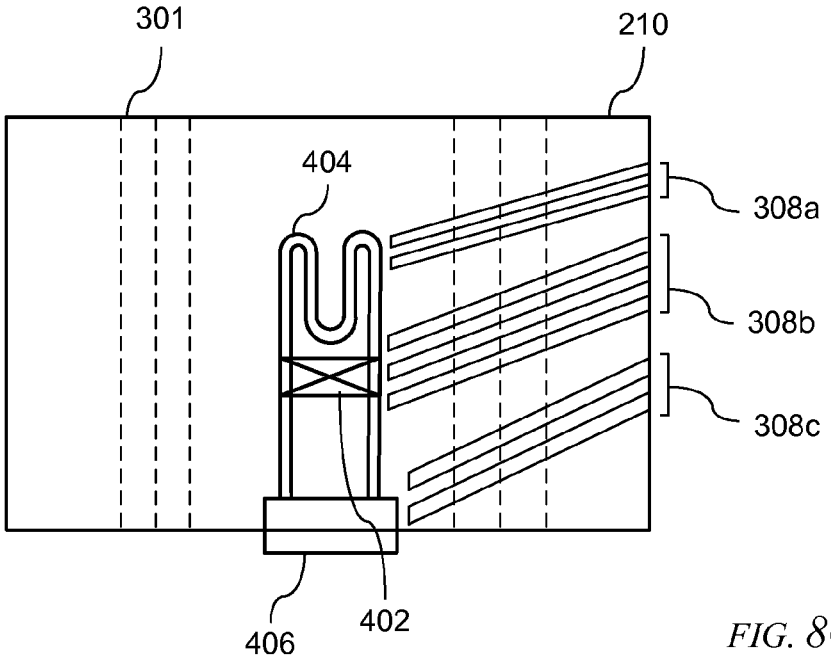
Figure 8D:
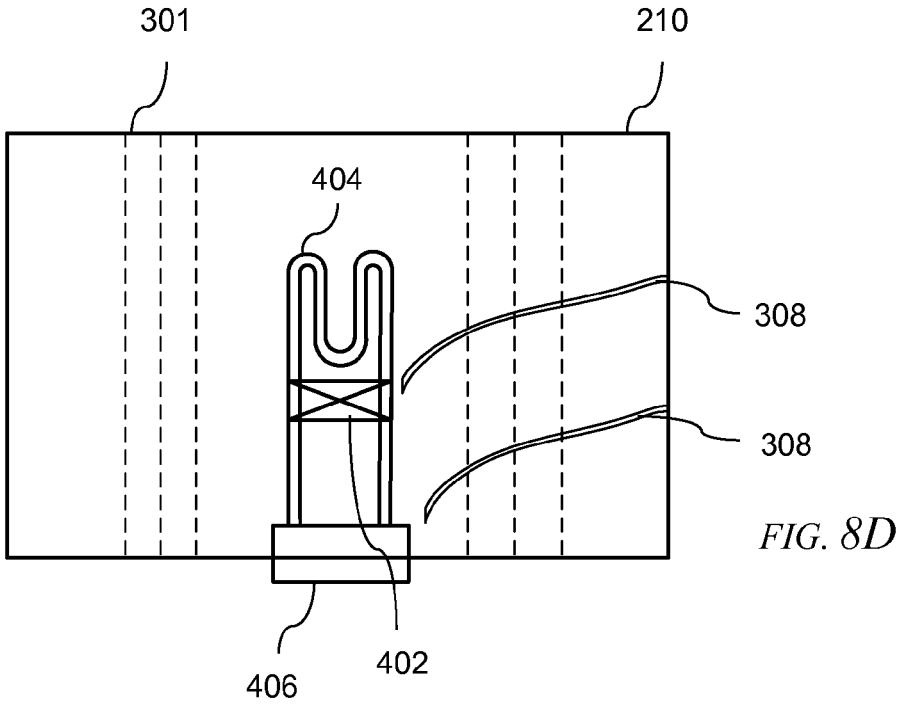
Figure 8E:
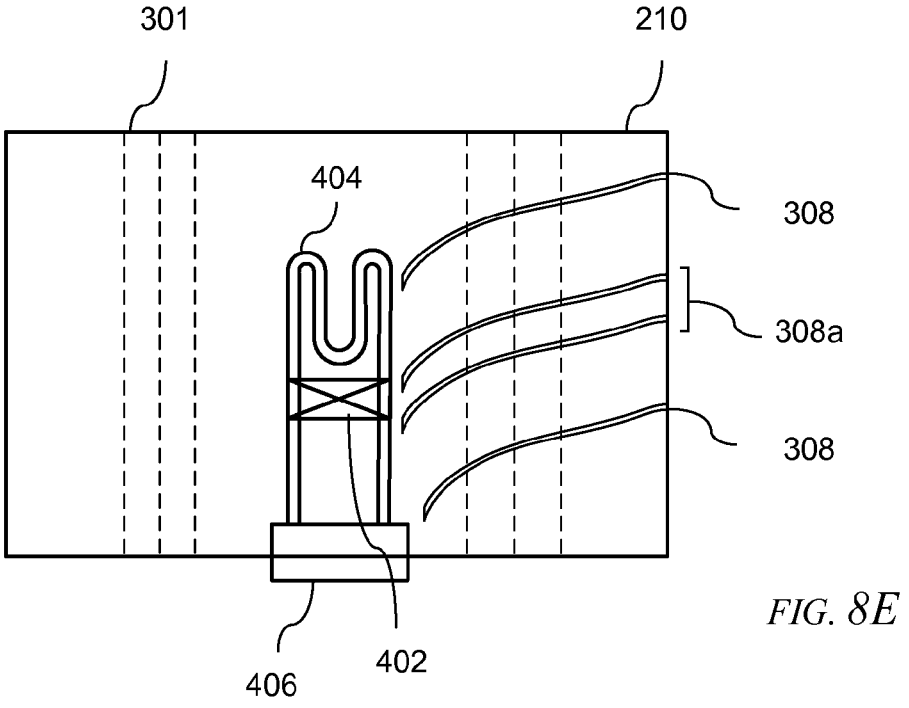
Figure 8F:
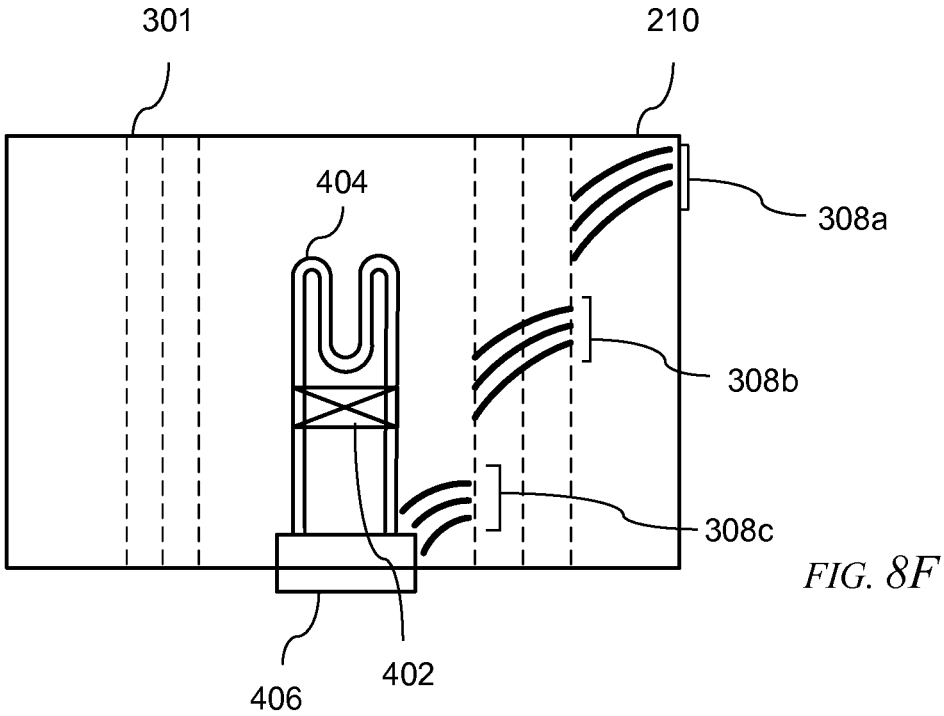

In other embodiments, one or more fluid guides 308 can be formed only on one of the interior surface of the tub 210 outside of (or adjacent to) to the heater pocket 300, the sidewall of the heater pocket 300, or the floor of the heater pocket 300. For example, as illustrated in FIG. 8F, an exemplary embodiment of the fluid guides 308*a* can be formed only on the interior surface of the tub 210 outside of (or adjacent to) to the heater pocket 300. In another exemplary embodiment illustrated in FIG. 8F, the fluid guides 308*b* can be formed only on the sidewall of the heater pocket 300. In yet another exemplary embodiment illustrated in FIG. 8F, the fluid guides 308*c* can be formed only on the floor of the heating pocket 300.

In other embodiments, one or more fluid guides 308 (or a portion thereof) can be formed on two or more of the interior surface of the tub 210 outside of (or adjacent to) to the heater pocket 300, the sidewall of the heater pocket 300, or the floor of the heater pocket 300 (as shown for example in FIGS. 8A-8E and 8G-8I).

For example, in other embodiments, one or more of the fluid guides 308 (or a portion thereof) can be formed on an interior surface of the tub 210 beginning outside of (or adjacent to) the heater pocket 300 and can continue onto the sidewall of the heater pocket 300. One or more of the fluid guides 308 also can be formed on an interior surface of the tub 210 beginning outside of (or adjacent to) the heater pocket 300 and continue onto the sidewall of the heater pocket 300, and then onto the floor of the heater pocket 300, as exemplarily illustrated in FIGS. 8A-8E and 8G-8I, thereby directing, guiding, or diverting the fluid from the tub 210 to predetermined areas, for example, of the heater element 404, heater retainer 402, or fixation base 406, etc. In another embodiment, one or more of the fluid guides 308 can be formed on the sidewall of the heater pocket 300, and continue onto the floor of the heater pocket 300.

The fluid guide 308 is not limited to the disclosed integrally formed embodiments and can be formed by a separate part that is secured or adhered to the interior of the heater pocket 300 and/or the tub 210 by conventional securing means commonly used in the art, or by an overmolded part, etc.

Figure 8G:
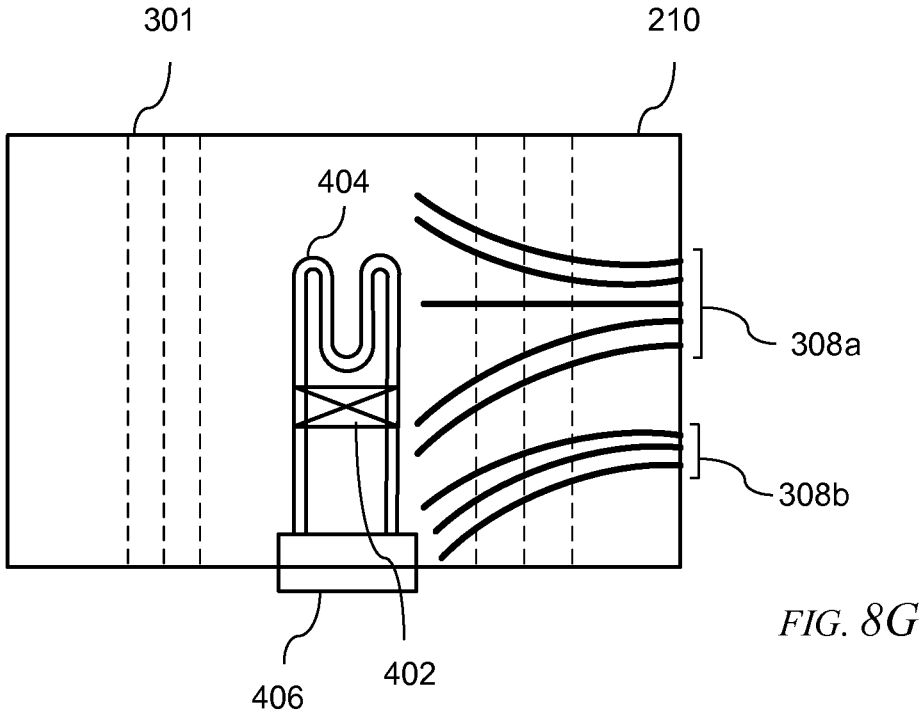

The fluid guide 308 can have, for example, an angled shape (as shown for example in FIGS. 8A-8C) or a curved (radii) shape (as shown for example in FIGS. 8D-8I) with respect to the flow path of the fluid in the tub 210 during the spinning cycle. The angled shape or a curved (radii) shape of the fluid guide 308 can guide (e.g., direct, divert, etc.) the fluid (or water) to one or more predetermined locations in the heater pocket 300, for example, for washing or cleaning debris from the heater element 404, base 406, or retainer clip 402. The angled or curved shapes of the fluid guides 308 need not be in the same direction. For example, as shown in FIG. 8G, the fluid guides 308 may split or fan out in a plurality of directions.

The fluid guide 308 can have a continuous shape (as shown in FIGS. 8A-8I), or be formed from a plurality of individual elements (e.g., a series of separated elements, such as small fins, dimples, etc., not shown) that operate in concert to direct or guide the fluid from the tub into the heater pocket 300.

Figure 8H:
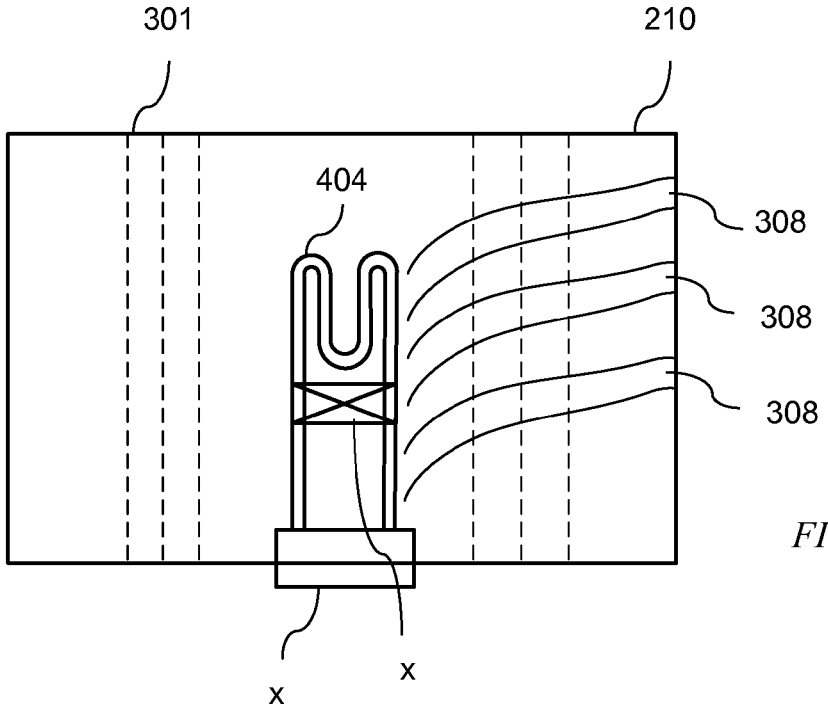
Figure 8I:
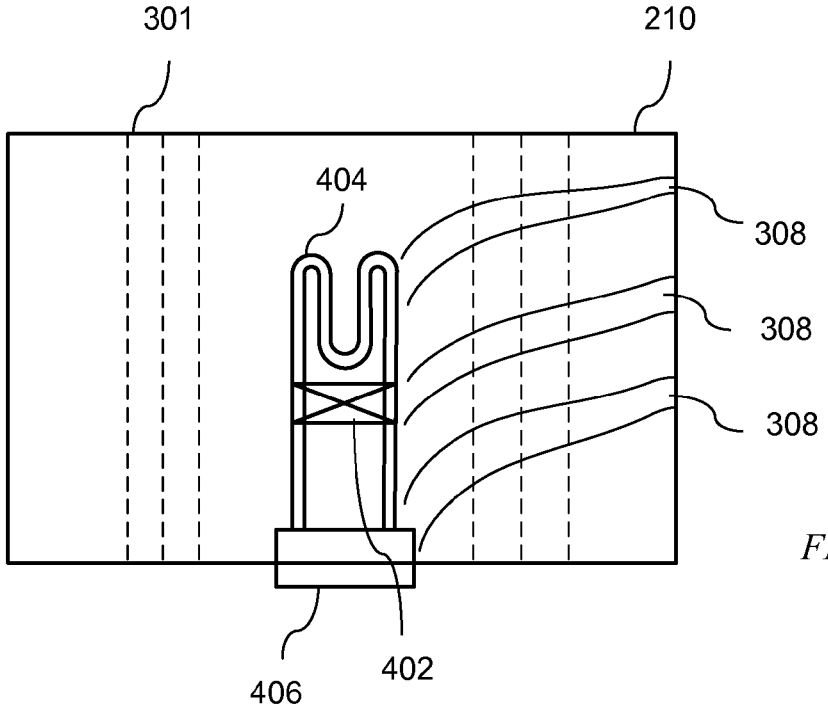

The fluid guide 308 can have a uniform shape or dimension along the length of the fluid guide 308 (as shown for example in FIGS. 8A-8G), or a varied shape or dimension along the length of the fluid guide 308 (as shown for example in FIGS. 8H-8I). For example, as shown in FIGS. 8H-8I, the fluid guide 308 may be wider or narrower along the length, or at one end of the length, of the fluid guide 308 to change the speed or acceleration of the water flowing in or along the fluid guide 308.

In another embodiment, the fluid guide 308 can be configured or shaped to generate a vortex or another flow pattern that improves the cleaning out of accumulated debris from under, on, or around the heating element 400.

With reference again to FIGS. 8A-8I, an embodiment can include a plurality of fluid guides 308 having a uniform pattern or spacing, or a varied or random pattern or spacing.

As shown for example in FIGS. 8C, 8E, 8F, and 8G, a portion of the fluid guides (e.g., 308*a*, 308*b*, 308*c*) can be grouped together to direct or guide the fluid to one or more predetermined locations in the heater pocket 300, for example, for washing or cleaning debris from the heater element 404, base 406, or retainer clip 402. For example, with reference to FIG. 8C, the plurality of fluid guides 308 may include a first group of fluid guides 308*a* that direct the fluid to a first predetermined portion of the heater pocket 300, such as the heater coil 404, a second group of fluid guides 308*b* that direct the fluid to a second predetermined portion of the heater pocket 300, such as the retainer clip 402, and a third group of fluid guides 308*c* that directs the fluid to a third predetermined portion of the heater pocket 300, such as the base 406.

In another example, as shown in FIG. 8F, one third of the fluid guides 308*a* may direct or guide water under the heater coils 404, one third of the fluid guides 308*b* may direct or guide water to the retainer clip 402, and one third of the fluid guides 308*c* may direct or guide water to the connection of the heating element base 406 to the tub 210.

The fluid guide 308 can direct or guide the flowing fluid to high critical points (e.g., around the heater coils, heater retainer, and/or heater fixation base) to flush, wash, or clean debris that has accumulated or been deposited in those areas. In an embodiment, the heater pocket 300 can include at least two fluid guides 308 that direct or guide the fluid to one or more predetermined flush points for debris removal within the heater pocket 300.

Each of the fluid guides 308 can have a uniform cross-sectional shape along a length of the fluid guide 308 (as shown for example in FIGS. 8A-8G) or a varying cross-sectional shape along a length of the fluid guide 308 (as shown for example in FIGS. 8H-8I).

With reference to FIGS. 9A-9K, the fluid guide 308 can be an integral or discrete element that directs or guides fluid from the tub 210 into the heater pocket 300 and/or breaks the water ring (i.e., disrupts circular flow of fluid in the tub 210) during a spinning cycle. The fluid guide can include, for example, a rib, blade, protrusion, recess, channel, groove, trough, emboss, or similar element, or a combination thereof, that directs or guides the fluid from the tub 210 into the heater pocket 300 and/or breaks the water ring during a spinning cycle.

Figure 9A:
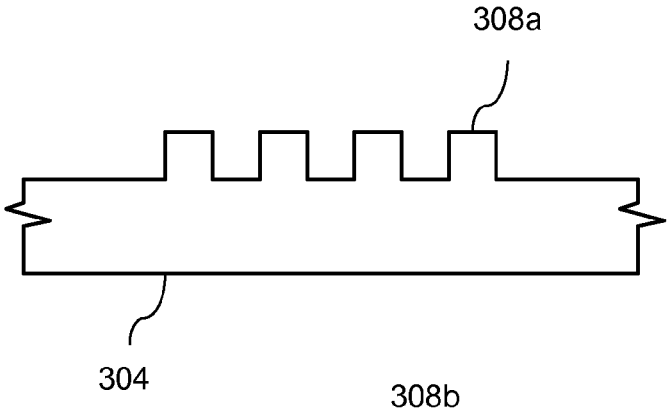
FIGS. 9A-9K are partial cross-sectional views of exemplary embodiments of a fluid guide of FIG. 7 taken along the line IX-IX.
Figure 9B:
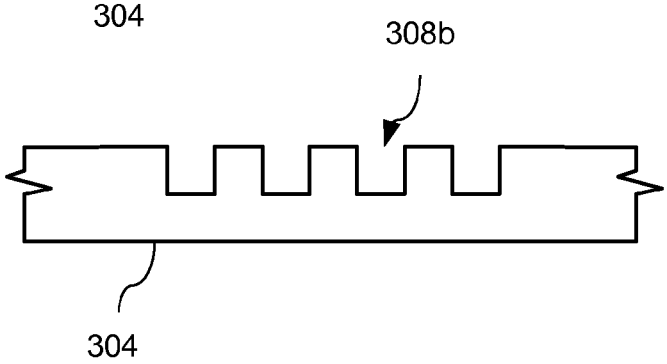
Figure 9C:
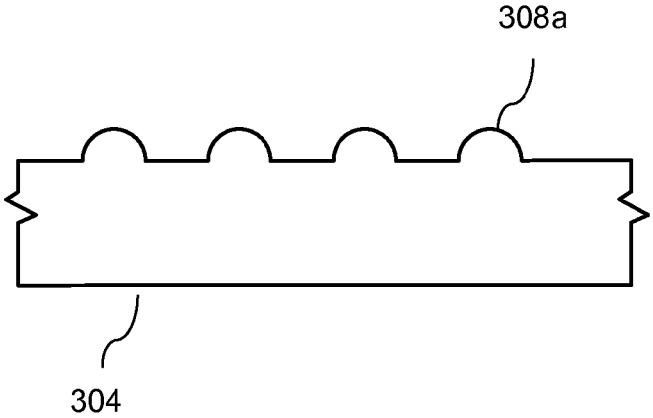
Figure 9D:
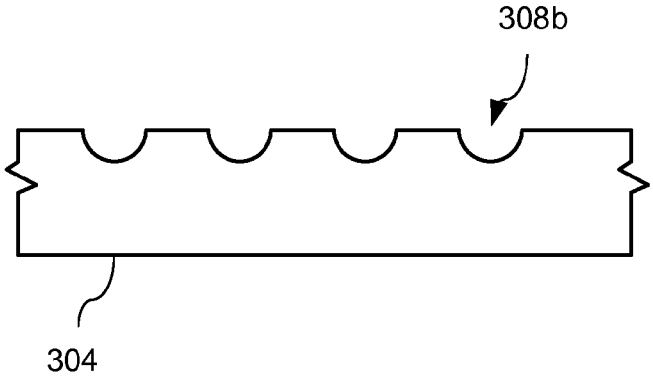
Figure 9E:
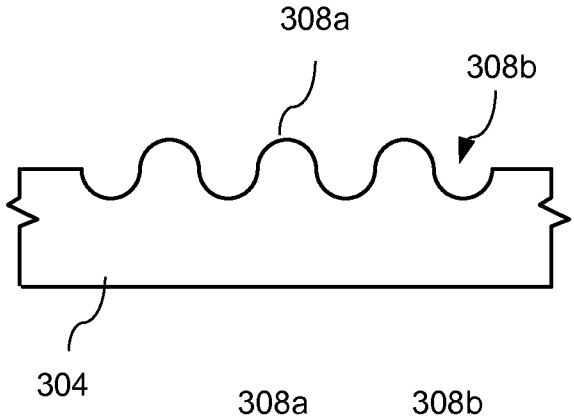
Figure 9F:
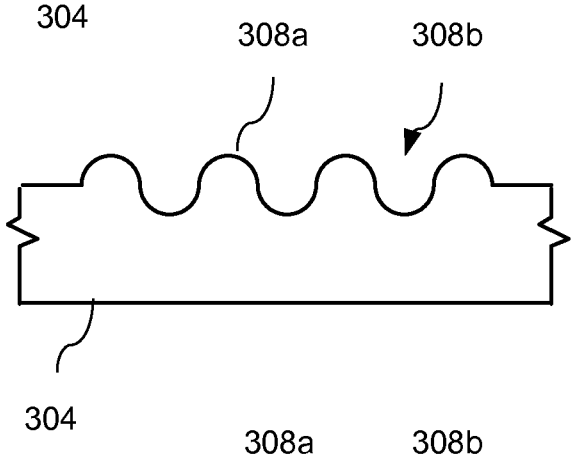
Figure 9G:
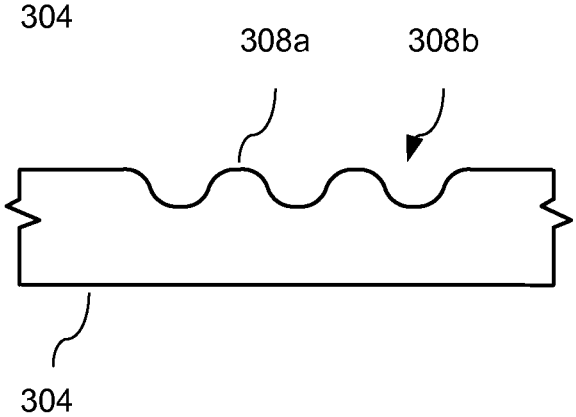
Figure 9H:
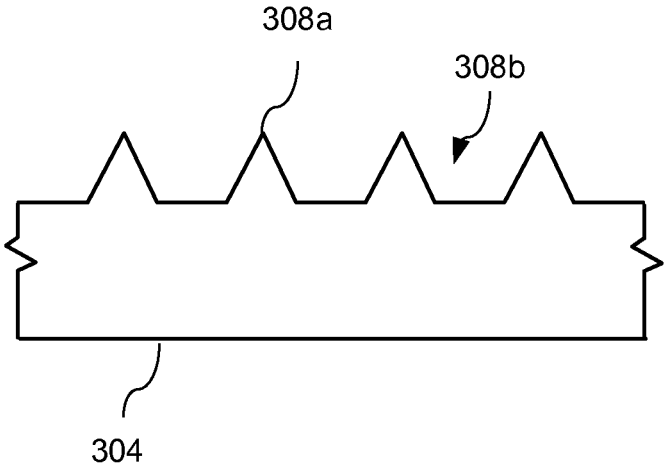
Figure 9I:
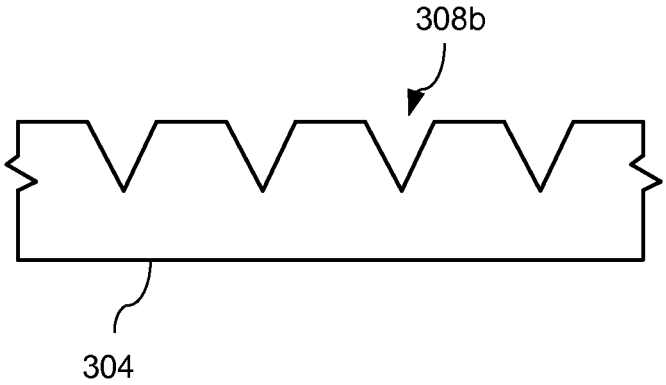
Figure 9J:
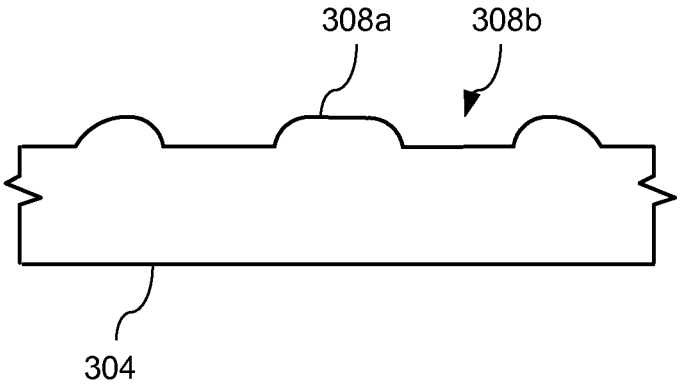
Figure 9K:
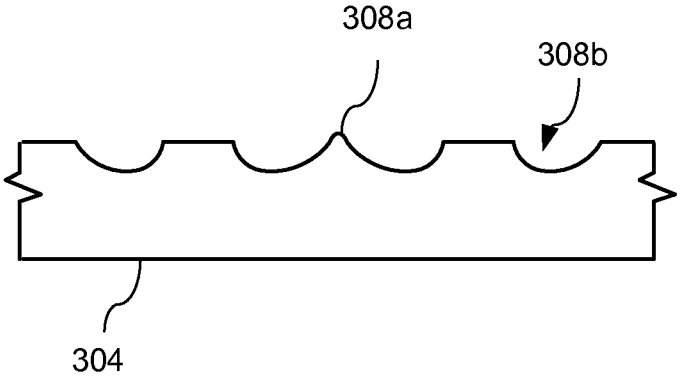

For example, the fluid guide 308 can have a square or rectangular cross-sectional shape (e.g., FIGS. 9A, 9B), a curved cross-sectional shape (e.g., FIGS. 9C-9G), a triangular cross-sectional shape (e.g., FIGS. 9H, 9I), or other cross-sectional shape, such as a random cross-sectional shape (e.g., FIGS. 9J, 9K).

With reference to FIGS. 9A and 9B, the fluid guide 308 can have a square cross-sectional shape that is formed by ribs (e.g., 308*a*) extending from the interior surface of the heater pocket 300, as shown in FIG. 9A, or by recesses (e.g., 308*b*) formed in the interior surface of the heater pocket 300, as shown in FIG. 9B. FIGS. 9C and 9D similarly show examples of the fluid guide 308 having a circular (or partial circular) cross-sectional shape that is formed by protrusions (e.g., 308*a*) extending from the interior surface of the heater pocket 300 or by troughs (e.g., 308*b*) formed in the interior surface of the heater pocket 300. FIGS. 9H and 9I similarly show examples of the fluid guide 308 having a triangular cross-sectional shape that is formed by raised portions (e.g., 308*a*) extending from the interior surface of the heater pocket 300 or by V-grooves (e.g., 308*b*) formed in the interior surface of the heater pocket 300. The exemplary embodiments of the fluid guide 308 can be a continuous shape (e.g., step, sinusoidal, etc., as shown for example in FIGS. 9E-9G) or separated by portions of the interior surface of the tub 210 or the interior surface of the heater pocket 300 (e.g., FIGS. 9A-9D and 9I-9K). The arrangements illustrated in FIGS. 9A-9K are for example purposes only and the embodiments are not limited to these disclosed exemplary embodiments.

A height or depth of the fluid guides 308 with respect to a main interior surface of the tub 210 is sufficient to guide (e.g., direct, divert, etc.) at least a portion of the fluid that is rotating in the tub 210 into the heater pocket 300 and/or to break the fluid ring (i.e., disrupt circular flow of fluid in the tub, or 'water ring') during, for example, a spinning cycle of the household appliance.

For example, with reference to FIG. 8F, a height of a fluid guide 308*a*, which is formed on the tub 210 (e.g., on the tub body or the circumferential tub body), can extend in a radial direction toward the axis of rotation of the rotatable drum 215 such that the fluid guide 308*a* projects into the space between the tub 210 and the drum 215 to guide (e.g., direct, divert, etc.) at least a portion of the fluid that is rotating in the tub 210 into the heater pocket 300 and/or to break the fluid ring (i.e., disrupt circular flow of fluid in the tub, or 'water ring') during, for example, a spinning cycle of the household appliance.

In another example, with reference to FIG. 8F, a height of a fluid guide 308*b* or 308*c*, which is formed on the sidewall of the heater pocket 300 and/or the floor of the heater pocket 300, can extend in a radial direction toward the axis of rotation of the rotatable drum 215 such that a first radial distance from the axis of rotation to the fluid guide is less than a second radial distance from the axis of rotation to the interior wall of the tub 210. In this manner, the fluid guide 308*b*, 308*c* can project into the space between the tub 210 and the drum 215 to guide (e.g., direct, divert, etc.) at least a portion of the fluid that is rotating in the tub 210 into the heater pocket 300 and/or to break the fluid ring (i.e., disrupt circular flow of fluid in the tub, or 'water ring') during, for example, a spinning cycle of the household appliance.

The height of the fluid guide 308 (e.g., 308*a*, 308*b*, 308*c*) may extend in a radial direction toward the axis of rotation of the drum 215 to a region immediately adjacent to the drum 215. The height of the fluid guide 308 may be selected to provide a predetermined clearance or tolerance between the fluid guide 308 and the drum 215 to prevent contact or interference between the fluid guide 308 and the rotating drum 215.

A height of each fluid guide 308 can be uniform or the same. Alternatively, one or more of the plurality of fluid guides 308 can have a height that is different than a height of another of the fluid guides 308. FIGS. 8A-9K are schematic representations, are not drawn to scale, and are intended for illustrative purposes only.

With reference again to FIGS. 1-4 and 7-9K, an exemplary embodiment is directed to a household appliance 100 including a housing 110 having a door 112 formed in a front panel thereof for accessing an interior of the housing 100, a tub 210 disposed inside the housing 110, and a rotatable drum 215 within the tub 210 and having an axis of rotation, the rotatable drum 215 for receiving laundry through the door 112. The tub 210 includes a tub body, a heater pocket 300 integrally formed in a lower portion of the tub body, the heater pocket 300 forming a cavity in fluid communication with the drum 215, the heater pocket 300 for at least partially surrounding a heating element 400 for heating a fluid in the tub 210, and a fluid guide 308 on an interior surface of the tub 210, the fluid guide 308 one of guiding the fluid from the tub body into the heater pocket 300 and disrupting a fluid ring formed in the tub body during rotation of the rotatable drum 215.

Another exemplary embodiment of the invention comprises a household appliance 100 including a housing 110 having a door 112 formed in a front panel thereof for accessing an interior of the housing 100, a tub 210 disposed inside the housing 110, and a rotatable drum 215 within the tub 210 and having an axis of rotation, the rotatable drum 215 for receiving laundry through the door 112. The tub 210 includes a tub body, a heater pocket 300 integrally formed in a lower portion of the tub body, the heater pocket 300 forming a cavity in fluid communication with the drum 215, the heater pocket

300 for at least partially surrounding a heating element 400 for heating a fluid in the tub 210, and guide means (e.g., 308, 308*a*, 308*b*, 308*c* in FIGS. 8A-9K, or similar elements or combinations) for one of guiding the fluid from the tub body into the heater pocket 300 and disrupting a fluid ring formed in the tub body during rotation of the rotatable drum 215.

Yet another exemplary embodiment includes a tub 210 for a household appliance 100 having a housing 110 with a door 112 formed in a front panel thereof for accessing an interior of the housing 110, the tub 210 for receiving a rotating drum 215 having an axis of rotation, and the drum 215 for receiving laundry through the door 112. The tub 210 includes a tub body, a heater pocket 300 integrally formed in a lower portion of the tub body, the heater pocket 300 for at least partially surrounding a heating element 400 for heating a fluid in the tub 210, and a fluid guide 308 on an interior surface of the tub 210, the fluid guide 308 one of guiding the fluid from the tub body into the heater pocket 300 and disrupting a fluid ring formed in the tub body during rotation of the rotatable drum 215.

In this manner, the exemplary embodiments can provide a heater pocket having a fluid guide that can guide (e.g., direct, divert, etc.) the fluid toward or directly onto area that are prone to the accumulation of debris, such as fluffs (e.g., lint or paper particles) and deposits or formation of lime. For example, one or more fluid guides can guide (e.g., direct, divert, etc.) the fluid directly onto one or more of the heater coils, the base, and/or the heating element retainer clip to flush or clean a portion or all of the debris from these areas. As a result, the exemplary embodiments can reduce or eliminate the deposition and accumulation of debris below, on, or around the heater coils, the base, and/or the heating element retainer clip, as well as other areas, thereby minimizing or eliminating a loss of efficiency of the heating element from deposition and accumulation of debris, and increasing a durability and reliability of the heating element.

The exemplary embodiments also can provide a heater pocket having a fluid guide that breaks or disrupts the water ring in the tub during the spinning cycle and guides (e.g., directs, diverts, etc.) the fluid into the heater pocket such that the water can be efficiently pumped or drained from the tub, thereby increasing the drainage efficiency of the household appliance, and improving the washing and cleaning affect of the water on areas that are prone to deposition and accumulation of debris. The exemplary embodiments can promote uniform flow of the fluid into the drain assembly during draining of the fluid, for example, during a spinning cycle. In this manner, the disclosed exemplary embodiments can reduce or eliminate stagnant areas, low flow areas, or irregular flow areas that may result in large amounts of debris collecting under, on, or around the heater coils. The exemplary embodiments can prevent or reduce the collection or accumulation of debris, such as fluffs (e.g., lint or paper particles) and lime deposits or formations under, on, or around the heater coils. In this manner, the exemplary embodiments may extend the operating life of the heater coils and increase the heat distribution from the heater coils to the fluid, thereby increasing the efficiency of the washer.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A household appliance comprising:

a housing having a door formed in a front panel thereof for accessing an interior of the housing;

a tub disposed inside the housing; and a rotatable drum within the tub and having an axis of rotation, the rotatable drum for receiving laundry through the door, wherein the tub includes:

a tub body;

a heater pocket integrally formed in a lower portion of the tub body, the heater pocket forming a cavity in fluid communication with the drum, the heater pocket for at least partially surrounding a heating element for heating a fluid in the tub; and a fluid guide on an interior surface of one of the tub body and the heater pocket, the fluid guide being an integral or discrete structural element formed on the interior surface and the fluid guide one of guiding the fluid flowing over the interior surface from the tub body into the heater pocket and disrupting a fluid ring formed in the tub body during rotation of the rotatable drum.

2. The household appliance of claim 1, wherein the fluid guide is integrally formed on the interior surface of the one of the tub body and the heater pocket.

3. The household appliance of claim 1, wherein the fluid guide is formed on an interior surface of the tub body that is adjacent to the heater pocket.

4. The household appliance of claim 1, wherein the fluid guide is formed on an interior surface of the tub body that is adjacent to the heater pocket and on an interior surface of the heater pocket.

5. The household appliance of claim 1, wherein the fluid guide is formed on an interior surface of the heater pocket, wherein a cross-section of the heater pocket, which is taken in a direction substantially perpendicular to the axis of rotation of the rotating drum, includes:

a first sidewall;

a second sidewall opposed to the first sidewall; and a bottom wall connecting a lower side of the first sidewall to a lower side of the second sidewall, wherein the fluid guide is formed on one of the first sidewall and the second sidewall of the heater pocket.

6. The household appliance of claim 1, wherein the fluid guide is formed on an interior surface of the heater pocket, wherein a cross-section of the heater pocket, which is taken in a direction substantially perpendicular to the axis of rotation of the rotating drum, includes:

a first sidewall;

a second sidewall opposed to the first sidewall; and a bottom wall connecting a lower side of the first sidewall to a lower side of the second sidewall, wherein the fluid guide is formed on the bottom wall of the heater pocket.

7. The household appliance of claim 1, wherein the fluid guide is formed only on an interior surface of the tub body that is adjacent to the heater pocket.

8. The household appliance of claim 1, wherein the fluid guide is formed only on an interior surface of the heater pocket.

9. The household appliance of claim 1, wherein the fluid guide is formed on one of an interior surface of the tub body that is adjacent to the heater pocket and on an interior surface of the heater pocket, and wherein the fluid guide is on an upstream side of the heating element with respect to a direction of flow of the fluid during a spinning cycle of the household appliance.

10. The household appliance of claim 1, wherein the fluid guide has one of an angled shape and a curved shape.

11. The household appliance of claim 1, wherein the fluid guide has a continuous shape.

12. The household appliance of claim 1, wherein the fluid guide has a uniform cross-sectional shape.

13. The household appliance of claim 1, wherein the fluid guide has a cross-sectional shape that varies along a length of the fluid guide.

14. The household appliance of claim 1, wherein the fluid guide includes a plurality of fluid guides.

15. The household appliance of claim 14, wherein the plurality of fluid guides has a uniform pattern.

16. The household appliance of claim 14, wherein the plurality of fluid guides includes a first group of fluid guides that guides the fluid to a first predetermined portion of the heater pocket.

17. The household appliance of claim 16, wherein the plurality of fluid guides includes a second group of fluid guides that guides the fluid to a second predetermined portion of the heater pocket.

18. The household appliance of claim 1, comprising:

the heating element disposed in the heater pocket, wherein the heating element includes a heater coil and a heating element base.

19. The household appliance of claim 18, wherein the fluid guide one of:

guides the fluid to one of below and around the heater coil; and guides the fluid to one of below and around the heating element base.

20. The household appliance of claim 18, comprising:

a heating element retainer that retains the heating element in the heater pocket, wherein the fluid guide guides the fluid to one of below and around the heating element retainer.

21. The household appliance of claim 1, wherein the household appliance is a front-loading washer.

22. A household appliance comprising:

a housing having a door formed in a front panel thereof for accessing an interior of the housing;

a tub disposed inside the housing; and a rotatable drum within the tub and having an axis of rotation, the rotatable drum for receiving laundry through the door, wherein the tub includes:

a tub body;

a heater pocket integrally formed in a lower portion of the tub body, the heater pocket forming a cavity in fluid communication with the drum, the heater pocket for at least partially surrounding a heating element for heating a fluid in the tub; and guide means for one of guiding the fluid from the tub body into the heater pocket and disrupting a fluid ring formed in the tub body during rotation of the rotatable drum.

23. The household appliance of claim 22, wherein the household appliance is a front-loading washer.

24. The household appliance of claim 22, wherein the guide means guides the fluid to a first predetermined portion of the heater pocket.

25. The household appliance of claim 24, wherein the guide means guides the fluid to a second predetermined portion of the heater pocket.

26. The household appliance of claim 22, comprising:

the heating element disposed in the heater pocket, wherein the heating element includes a heater coil and a heating element base, and wherein the guide means one of guides the fluid to one of below and around the heater coil, and to one of below and around the heating element base.

27. The household appliance of claim 22, comprising:

the heating element disposed in the heater pocket, a heating element retainer that retains the heating element in the heater pocket, wherein the guide means guides the fluid to one of below and around the heating element retainer.

28. A tub for a household appliance having a housing with a door formed in a front panel thereof for accessing an interior of the housing, the tub for receiving a rotating drum having an axis of rotation, and the drum for receiving laundry through the door, the tub comprising:

a tub body;

a heater pocket integrally formed in a lower portion of the tub body, the heater pocket for at least partially surrounding a heating element for heating a fluid in the tub; and a fluid guide on an interior surface of one of the tub body and the heater pocket, the fluid guide being a structural element formed on the interior surface, and the fluid guide one of guiding the fluid from the tub body into the heater pocket and disrupting a fluid ring formed in the tub body during rotation of the rotatable drum.

29. The household appliance of claim 1, wherein the fluid guide is coupled to the interior surface of the tub.

30. The household appliance of claim 1, wherein the fluid guide comprises an integral or discrete structural element that at least one of diverts the fluid from within the tub body into the heater pocket and disrupts a fluid ring formed in the tub body during rotation of the rotatable drum, wherein the integral or discrete structural element at least one of:

extends away from the interior surface and in a first direction toward an interior of at least one of the heater pocket and an interior of the tub body, wherein the fluid guide comprises at least one of a rib, blade, diverter, protrusion, emboss, and a raised shape; and extends into the interior surface and in a second direction away from the interior of at least one of the heater pocket and the interior of the tub body, wherein the fluid guide comprises at least one of a recess, channel, groove, trough, and indention.

31. The household appliance of claim 1, wherein the fluid guide projects into a space between the tub body and the rotatable drum to at least one of divert the fluid from within the tub body into the heater pocket and disrupt a fluid ring formed in the tub body during rotation of the rotatable drum.

* * * * *